US009605449B2

(12) United States Patent
Rosales et al.

(10) Patent No.: US 9,605,449 B2
(45) Date of Patent: Mar. 28, 2017

(54) MOTOR VEHICLE LOCK

(71) Applicant: Brose Schliesssysteme GmbH & Co. KG, Wuppertal (DE)

(72) Inventors: David Rosales, Rochester Hills, MI (US); Michael Wittelsbuerger, Lake Orion, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 0 days.

(21) Appl. No.: 13/929,196

(22) Filed: Jun. 27, 2013

(65) Prior Publication Data

US 2014/0284940 A1 Sep. 25, 2014

Related U.S. Application Data

(60) Provisional application No. 61/804,910, filed on Mar. 25, 2013.

(51) Int. Cl.
*E05C 3/16* (2006.01)
*E05B 77/04* (2014.01)

(52) U.S. Cl.
CPC ..... *E05B 77/04* (2013.01); *Y10T 292/0908* (2015.04)

(58) Field of Classification Search
CPC ..... E05B 77/06; E05B 77/04; Y10T 292/0908
USPC ..... 292/92, 194, 216, 336.3, DIG. 22, 292/DIG. 65; 296/187.12
See application file for complete search history.

(56) References Cited

U.S. PATENT DOCUMENTS 4,995,654 A * 2/1991 Nishigami et al. ..... 292/216
6,065,797 A * 5/2000 Shirasaka ..... 296/146.6
7,111,880 B2 * 9/2006 Saitoh ..... 292/336.3
(Continued)

FOREIGN PATENT DOCUMENTS

DE 102012000452 A1 * 9/2012 ..... E05B 77/04
JP S56148464 11/1981
WO 2012/130201 10/2012

OTHER PUBLICATIONS

Partial European Search Report for European Patent Application No. 14161236, related to co-pending U.S. Appl. No. 13/929,196 mailed Feb. 26, 2016 (8 pages).

*Primary Examiner* — Kristina Fulton
*Assistant Examiner* — Christine M Mills
(74) *Attorney, Agent, or Firm* — Pauly, Devries, Smith & Deffner, LLC

(57) ABSTRACT

The invention is directed to a lock for a door arrangement, wherein a catch and a pawl, which is assigned to the catch, are provided. The catch can be brought into an open position and into a closed position. The catch may be brought into holding engagement with a lock striker. The pawl may be brought into an engagement position or deflected into a release position. A lock mechanism and a crash mechanism with a crash element are provided. The crash mechanism may be brought from a normal condition into a crash condition. A switchable coupling is provided between the pawl actuation arrangement and the pawl. The crash element is acting on the switchable coupling or is part of the switchable coupling in such a way that bringing the crash mechanism into the crash condition opens the switchable coupling and lets the actuation of the pawl actuation arrangement run free.

8 Claims, 4 Drawing Sheets

(56) References Cited

U.S. PATENT DOCUMENTS

2007/0069525 A1* 3/2007 Ghannam ..... E05B 77/04
292/216

* cited by examiner

MOTOR VEHICLE LOCK

CLAIM OF PRIORITY

This application claims the benefit of priority, under 35 U.S.C. Section 119(e), to U.S. Provisional Application No. 61/804,910, filed Mar. 25, 2013, which is hereby incorporated by reference herein in its entirety.

FIELD OF THE INVENTION

The invention is directed to a motor vehicle lock and to a motor vehicle door arrangement.

BACKGROUND

The motor vehicle lock in question is assigned to a motor vehicle door arrangement which comprises at least a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

The crash safety plays an important role for today's motor vehicle locks. It is of particular importance that neither crash induced acceleration nor crash induced deformation leads to an unintended opening of the motor vehicle door which the motor vehicle door lock is assigned to. The focus of the present application is to prevent an unintended opening of the motor vehicle door based on crash induced deformation, for example a crash induced deformation of a door body shell.

The known motor vehicle lock (WO 2012/130201 A2), which is the starting point for the invention, is provided with a crash mechanism which prevents a crash induced and unintended opening of the motor vehicle door. In case of a crash induced deformation of a door body shell the respective section of the door body shell comes into engagement with the crash mechanism which leads to the crash mechanism being brought from a normal condition into a crash condition. The crash mechanism comprises a crash element which is actually a blocking element for a pawl actuation lever. When the crash mechanism is in its crash condition, the actuation of the pawl actuation lever is being blocked by the crash element.

The known motor vehicle lock is generally advantageous as it reacts to crash induced deformation, and not to crash induced acceleration. With this it is possible to react to crash induced situations that require the prevention of opening of the motor vehicle door but that, however, do not show high crash induced accelerations.

A disadvantage of the known motor vehicle lock is the difficult design of the drive train that allows opening the motor vehicle door by an outer door handle or the like. As the crash mechanism of the known motor vehicle lock reacts to the crash induced deformation by blocking part of the drive train, the crash induced actuation forces on the outer door handle are being transferred into the motor vehicle lock. In order to prevent non-reproducible breakage of the drive train, this drive train has to be designed for correspondingly high actuation forces. As noted above, however, those high crash induced actuation forces may not even be present during the above noted, crash induced deformation such that in the end for many crash situations the drive train would be oversized.

SUMMARY

It is the object of the invention to improve the known motor vehicle lock such that a cost effective constructional design is possible without reducing the resulting crash safety.

The above noted object is solved for a motor vehicle lock for a motor vehicle door arrangement, wherein a catch and a pawl, which is assigned to the catch, are provided, wherein the catch can be brought into an open position and into a closed position, wherein the catch, which is in the closed position, is or may be brought into holding engagement with a lock striker, wherein the pawl may be brought into an engagement position, in which it is in blocking engagement with the catch and wherein the pawl may be deflected into a release position, in which it releases the catch, wherein a lock mechanism is provided, which may be brought into different functional states such as "unlocked" and "locked" via a lock actuation arrangement and wherein a pawl actuation arrangement is provided, by which actuation the pawl may deflected into the release position depending on the functional state of the lock mechanism, wherein a crash mechanism with a crash element is provided, which crash mechanism may be brought from a normal condition into a crash condition by engagement with a component of the motor vehicle door arrangement, in particular a door body shell, which component is being deformed due to a crash, wherein a switchable coupling is provided between the pawl actuation arrangement and the pawl and that the crash element is acting on the switchable coupling or is part of the switchable coupling in such a way that bringing the crash mechanism into the crash condition opens the switchable coupling and therewith lets an actuation of the pawl actuation arrangement run free.

The basic idea underlying the present invention is to let the pawl actuation arrangement run free in case a crash induced deformation brings the crash mechanism into the crash condition. With this the drive train assigned to the actuation arrangement may be designed in view of rather low actuation forces even in view of the occurrence of a possible crash.

In further detail a switchable coupling is provided between the pawl actuation arrangement and the pawl, wherein the crash element is acting on the switchable coupling or is part of the switchable coupling in such a way that bringing the crash mechanism into the crash condition opens the switchable coupling and therewith lets an actuation of the pawl actuation arrangement run free.

In addition to the cost effective design of the above noted drive train the crash mechanism as well as the switchable coupling may be designed for low actuation forces as well. As a result a considerable cost reduction may be achieved with the present invention.

According to an embodiment, the crash mechanism comprises a crash engagement element which serves for receiving the crash induced deformation of a corresponding component like a door body shell. For transfer of the deformation movement the crash engagement element is coupled correspondingly with the crash element. In a preferred embodiment the crash element and the crash engagement element are being designed as a one-piece component.

According to an embodiment, it is interesting that the switchable coupling is not only used by the crash mechanism, but also by the lock mechanism, namely to realize the different functional states, such as "unlocked" and "locked". This double-use of the switchable coupling plays an important role for the above noted, cost effective design.

The further preferred embodiments are directed to preferred constructional measures. An embodiment wherein at least part of the crash engagement element is provided by a bendable wire or strip, leads to outstanding cost savings regarding the production of the motor vehicle lock.

An alternative embodiment, which is independently important, is directed to the idea of providing at least part of the crash engagement element by a bendable wire or strip. It has been found that this basic idea is not only cost effective, but that a bendable wire or strip can receive a crash induced deformation movement in an optimal way. The bendability guarantees a certain amount of deformation of the crash engagement element itself without breaking it, such that the function of the crash engagement element is always guaranteed.

It is to be understood that for the second teaching it is not in any case necessary to have a lock mechanism and/or a crash mechanism based on the above noted free run concept.

Accordingly, the second teaching proposes for a motor vehicle lock that the crash mechanism comprises a crash engagement element for engagement of the component of the motor vehicle door arrangement, which component is being deformed by a crash, that the crash engagement element is coupled to the crash element in order to transfer at least part of the crash induced deformation movement to the crash element and that at least part of the crash engagement element is provided by a bendable wire or strip.

With regard to the material selection for the bendable wire or strip, various preferred alternatives are possible. In one particularly preferred development, the bendable wire or strip is composed of a metal material, preferably spring steel. It may however also be advantageous for the bendable wire or strip to be formed from a plastic material.

For the shaping of the bendable wire or strip, various advantageous alternatives are considerable as well. The bendable wire preferably has a circular cross section. The strip preferable has a rectangular cross section.

A third teaching, which is independently important as well, is directed to a motor vehicle door arrangement with a motor vehicle door and a motor vehicle lock. Preferably the motor vehicle lock is arranged in or at the motor vehicle door. The motor vehicle lock then interacts with a lock striker which is arranged at the motor vehicle body. The motor vehicle lock for this motor vehicle door arrangement is one of the above noted, proposed motor vehicle locks. Accordingly it may be referred to all explanations given with respect to the proposed motor vehicle locks.

In an embodiment, the invention provides a motor vehicle lock for a motor vehicle door arrangement, wherein a catch and a pawl, which is assigned to the catch, are provided, wherein the catch can be brought into an open position and into a closed position, wherein the catch, which is in the closed position, is or may be brought into holding engagement with a lock striker, wherein the pawl may be brought into an engagement position, in which it is in blocking engagement with the catch and wherein the pawl may be deflected into a release position, in which it releases the catch, wherein a lock mechanism is provided, which may be brought into different functional states such as "unlocked" and "locked" via a lock actuation arrangement and wherein a pawl actuation arrangement is provided, by which actuation the pawl may deflected into the release position depending on the functional state of the lock mechanism, wherein a crash mechanism with a crash element is provided, which crash mechanism may be brought from a normal condition into a crash condition by engagement with a component of the motor vehicle door arrangement, in particular a door body shell, which component is being deformed due to a crash, wherein a switchable coupling is provided between the pawl actuation arrangement and the pawl and that the crash element is acting on the switchable coupling or is part of the switchable coupling in such a way that bringing the crash mechanism into the crash condition opens the switchable coupling and therewith lets an actuation of the pawl actuation arrangement run free.

In one embodiment, the crash mechanism comprises a crash engagement element for engagement of the component of the motor vehicle door arrangement, which component is being deformed by a crash, and that the crash engagement element is coupled to the crash element in order to transfer at least part of the crash induced deformation movement to the crash element.

In one embodiment, the lock mechanism acts on the switchable coupling for realizing the functional states "unlocked" and "locked" such that in the functional state "unlocked" the switchable-coupling closes and in the functional state "locked" opens.

In one embodiment, the switchable coupling comprises a coupling lever which is part of the drive train between the pawl actuation arrangement and the pawl that the coupling lever may be brought into a closed state in which it closes the drive train and into an open state in which it opens the drive train.

In one embodiment, the pawl actuation arrangement comprises a pawl actuation lever which is pivotable around a pawl actuation lever axis and that the coupling lever is linked to the pawl actuation lever eccentrically with respect to the pawl actuation lever axis.

In one embodiment, wherein the coupling lever comprises an engagement area and that a subsequent drive train component, which is or may be coupled to the pawl, comprises a counter engagement area and that while the switchable coupling is in the closed state, by actuation of the pawl actuation arrangement, the engagement area comes into engagement with the counter engagement area for deflecting the pawl into the release position.

In one embodiment, in case the switchable coupling is closed and the pawl actuation arrangement is being actuated, bringing the crash mechanism into the crash condition causes to open the switchable coupling.

In one embodiment, the crash element is pivotable around a crash element axis and comprises an arm to come into engagement with the switchable coupling when the crash mechanism is being brought into the crash condition.

In one embodiment, the crash engagement element is at least partly located at the outside of the motor vehicle lock.

In one embodiment, the crash engagement element comprises a bow like section which at least on two end portions is being supported by a support arrangement.

In one embodiment, at least part of the crash engagement element is provided by a bendable wire or strip.

In an embodiment, the invention provides a motor vehicle lock for a motor vehicle door arrangement, wherein a catch and a pawl, which is assigned to the catch, are provided, wherein the catch can be brought into an open position and into a closed position, wherein the catch, which is in the closed position, is or may be brought into holding engagement with a lock striker, wherein the pawl may be brought into an engagement position, in which it is in blocking engagement with the catch and wherein the pawl may be deflected into a release position, in which it releases the catch, wherein a crash mechanism with a crash element is provided, which crash mechanism may be brought from a normal condition into a crash condition by engagement with a component of the motor vehicle door arrangement, in particular a door body shell, which component is being deformed due to a crash, wherein the crash mechanism comprises a crash engagement element for engagement of the component of the motor vehicle door arrangement, which component is being deformed by a crash, that the crash engagement element is coupled to the crash element in order to transfer at least part of the crash induced deformation movement to the crash element and that at least part of the crash engagement element is provided by a bendable wire or strip.

In one embodiment, the bendable wire or strip provides a bow like section which at least on two end portions is being supported by a support arrangement.

In one embodiment, a Motor vehicle lock is assigned to the motor vehicle door of a motor vehicle door arrangement.

In an embodiment, the motor vehicle door comprises a door body shell and that a crash engagement element of the crash mechanism is arranged adjacent the door body shell.

BRIEF DESCRIPTION OF THE FIGURES

In the following the invention will be described in an example referring to the drawings. The drawings show.

DETAILED DESCRIPTION

Figure 1:
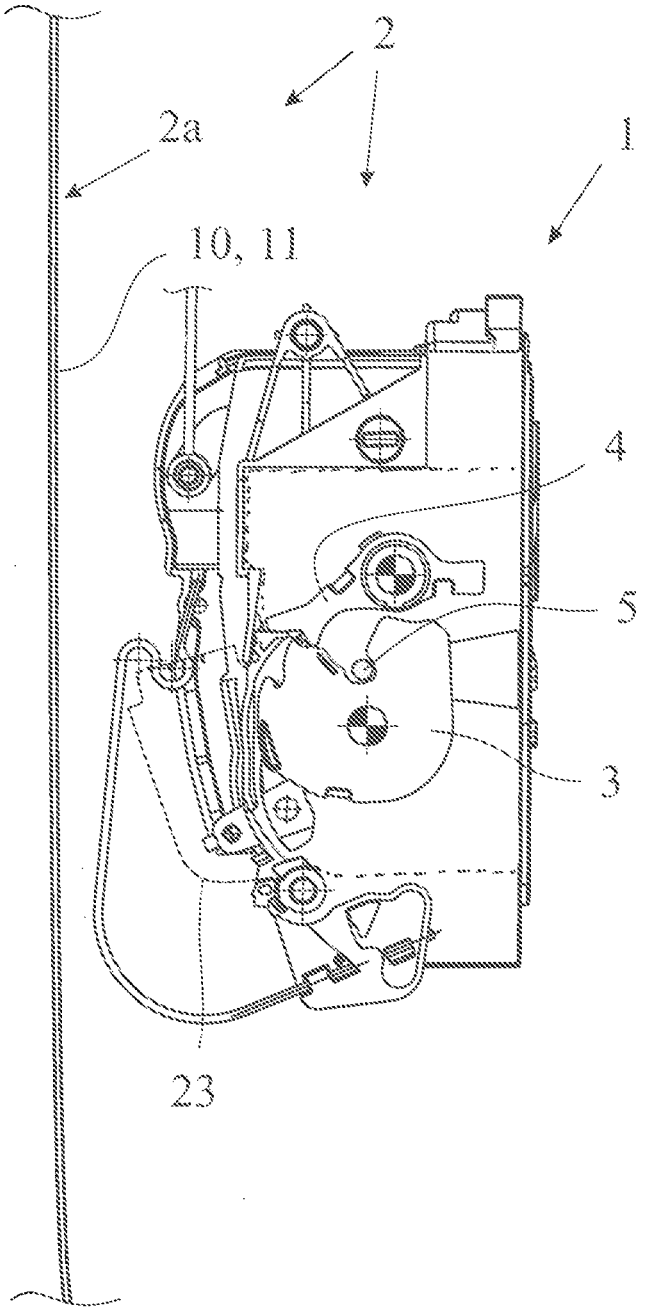
FIG. 1 a proposed motor vehicle lock in top view omitting part of the housing, FIG. 2 the motor vehicle lock according to FIG. 1 omitting further components a) in the unlocked functional state without actuation and b) in the unlocked functional state during actuation, FIG. 3 the proposed motor vehicle lock according to the display of FIG. 2 in the locked functional state without actuation and FIG. 4 the proposed motor vehicle lock according to the display of FIG. 2 a) with the crash mechanism in the crash condition without actuation and b) with the crash mechanism in the crash condition during actuation.

The motor vehicle lock 1 shown in the drawings is assigned a motor vehicle door arrangement 2, which comprises a motor vehicle door 2*a* besides said motor vehicle lock 1. Regarding the broad interpretation of the expression "motor vehicle door" reference is made to the introductory part of the specification. Here and preferably the motor vehicle door 2*a* is a side door of the motor vehicle.

The motor vehicle lock 1 comprises the usual locking elements catch 3 and pawl 4, which is assigned to the catch 3. The catch 3 can be brought into an open position (not shown) and into a closed position (FIG. 1). In the closed position shown in FIG. 1 the catch 3 is or may be brought into holding engagement with a lock striker 5 that is indicated in FIG. 1 as well. The motor vehicle lock 1 is normally arranged at or in the motor vehicle door 2*a*, while the lock striker 5 is arranged at the motor vehicle body.

The pawl 4 may be brought into an engagement position shown in FIG. 1, in which it is in blocking engagement with the catch 3. Here an preferably the pawl 4 blocks the catch 3 in its closed position in a mechanically stable manner such that the pawl 4 itself does not have to be blocked. For release of the catch 3 into its open position the pawl 4 may be deflected into a release position (not shown), which would be a deflection in the clockwise direction in FIG. 1.

Further, a lock mechanism 6 is provided, which may be brought into different functional states, such as "unlocked" and "locked" via a lock actuation arrangement 7. In addition a pawl actuation arrangement 8 is provided, by which actuation the pawl 4 may be deflected into the released position depending on the functional state of the lock mechanism 6.

Figure 2:
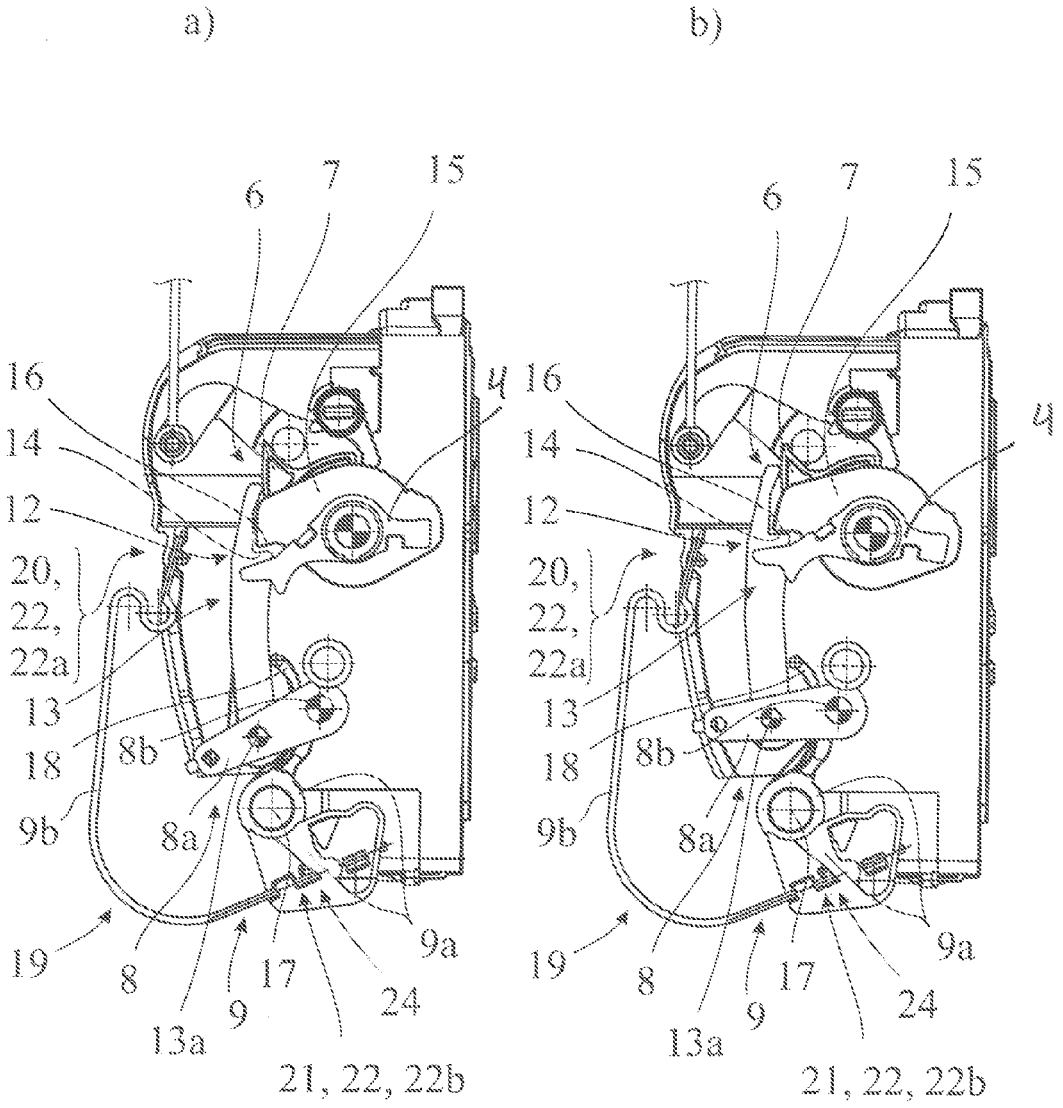
Figure 3:
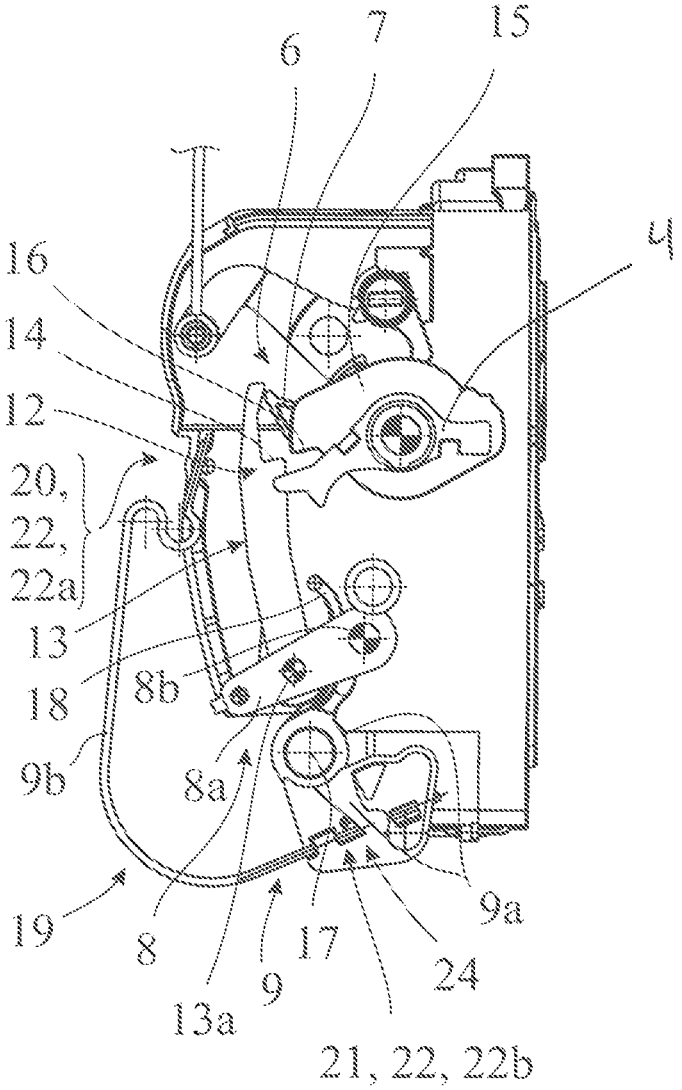
Figure 4:
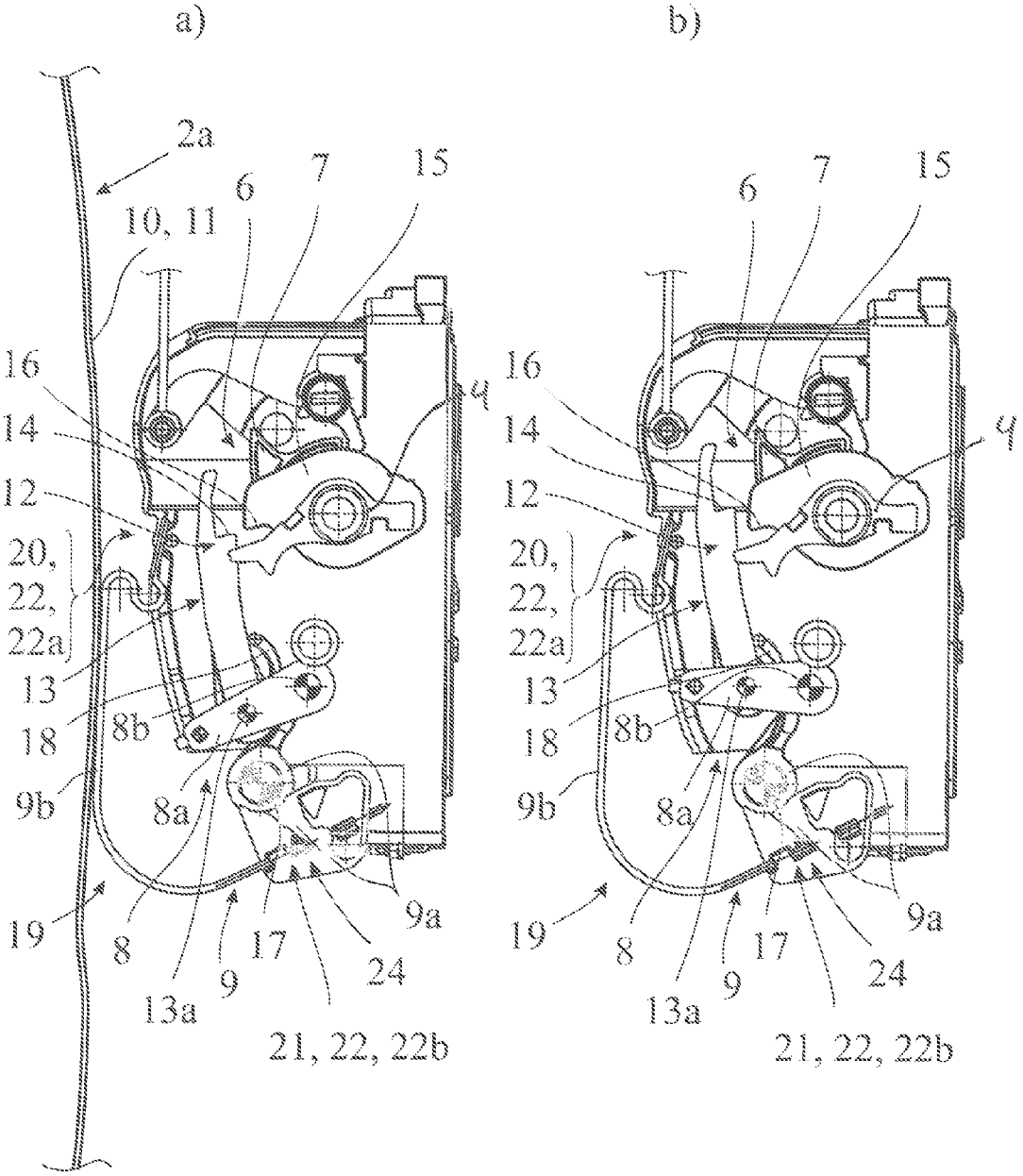

FIGS. 2 to 4 show the motor vehicle lock according to FIG. 1 omitting for example the catch 3 and various housing details for easy understanding.

The pawl actuation arrangement 8 here and preferably serves to deflect the pawl 4 into its release position by the actuation of an outer door handle, not shown. For this, the pawl actuation arrangement 8 comprises at least a pawl actuation lever 8*a* which may be connected to the outer door handle via a Bowden cable or the like. For actuation the pawl actuation lever 8*a* is being pivoted in clockwise direction.

If the lock mechanism 6 is in the functional state "unlocked" an actuation of the pawl actuation lever 8*a* causes the deflection of the pawl 4 into its release position. If the lock mechanism 6 is in its functional state "locked" the actuation of the pawl actuation lever 8*a* does not have any effect on the pawl 4. The detailed functionality of the lock mechanism 6 will be described further down.

The motor vehicle lock 1 is also provided with a crash mechanism 9 with a crash element 9*a*, which crash mechanism 9 may be brought from a normal condition (FIG. 2, 3) into a crash condition (FIG. 4) by engagement of the crash mechanism 9 with a component 10 of the motor vehicle door arrangement, here and preferably with a door body shell 11, which component 10 is being deformed due to a crash. A comparison of FIGS. 1 and 4*a* shows that the door body shell 11 has been deformed in the drawings to the right thereby moving at least a part of the crash mechanism 9 with the crash induced deformation.

It is of particular importance now that a switchable coupling 12 is provided between the pawl actuation arrangement 8 and the pawl 4 and that the crash element 9*a* is acting on the switchable coupling 12 in such a way that bringing the crash mechanism 9 into the crash condition (FIG. 4) opens the switchable coupling 12 and therewith lets an actuation of the pawl actuation arrangement 8 run free (FIG. 4*b*).

For reception of the above noted crash induced deformation the crash mechanism 9 comprises a crash engagement element 9*b*, which is designed for engagement of the respective component 10 of the motor vehicle door arrangement, which component 10 is being deformed by a crash. The crash engagement element 9*b* is coupled to the crash element 9*a* in order to transfer at least part of the crash induced deformation movement to the crash element 9*a*. A comparison of FIG. 2*a* with FIG. 4*a* shows that the crash induced deformation leads to a movement of the crash engagement element 9*b* which as a result leads to pivoting the crash element 9*a* in a counter clockwise direction in the drawings.

It has been noted above that the switchable coupling 12 is used not only by the crash mechanism 9, but also by the lock mechanism 6. In particular the lock mechanism 6 acts on the switchable coupling 12 for realizing the functional states "unlocked" and "locked" such that in the functional state "unlocked" the switchable coupling 12 closes the drive train (FIG. 2) and in the functional state "locked" opens the drive train (FIG. 3). For this the lock actuation arrangement 7 is designed as a lever, which acts on the switchable coupling 12, in particular on a coupling lever 13 to be described, as shown in FIG. 3. In the functional state "locked" the actuation arrangement 7 moves the coupling lever 13 counter clockwise which leads to the switching coupling 12 to be opened. The lock actuation arrangement 7 may be operated manually by the user or motor driven by a central locking drive.

The switchable coupling 12 shown in the drawings is of simple structure and comprises said coupling lever 13 which is part of the drive train between the pawl actuation arrangement 8 and the pawl 4. The coupling lever 13 may be brought into a closed state in which it closes the drive train (FIG. 2) and into an open state in which it opens the drive train (FIG. 3, 4). For this the coupling lever 13 is pivotable around a coupling lever axis 13*a* as may be seen from a comparison between the FIGS. 2*a* and 4*a*. In the shown and insofar preferred embodiment the pawl actuation arrangement 8 comprises the noted pawl actuation lever 8*a* which is pivotable around a pawl actuation lever axis 8*b*. In the shown embodiment the coupling lever 13 is linked to the pawl actuation lever 8*a* eccentrically to the pivot axis 8*b* of the pawl actuation lever 8*a*. This means that the coupling lever axis 13*a* is offset to the pawl actuation lever axis 8*b*.

The coupling lever 13 here and preferably is of oblong design and comprises the coupling lever axis 13*a* on one end and an engagement area 14 on the other end.

In general it is provided that the coupling lever 13 comprises said engagement area 14 while a subsequent drive train component, here and preferably a pawl lever 15, comprises a counter engagement area 16. The pawl lever 15 is coupled to the pawl 4 such that pivoting of the pawl lever 15 in the clockwise direction leads to deflecting the pawl 4 in the clockwise direction as well which leads to deflecting the pawl 4 into its release position. Depending on the application the pawl lever 15 may always be coupled to the pawl 4 or may be coupled to the pawl 4 only if needed.

While the switchable coupling 12 is in the closed state (FIG. 2), by actuation of the pawl actuation arrangement 8, here and preferably by pivoting the pawl actuation lever 8*a* in clockwise direction, the engagement area 14 comes into engagement with the counter engagement area 16 which leads to deflection of the pawl 4 into its release position (FIG. 2*b*).

It may be taken from the drawings that the switchable coupling 12 is mainly based on the engagement area 14 and the counter engagement area 16 which makes the coupling very simple in constructional view.

It is particularly interesting that both engagement areas 14, 16 are simply realized as edges that for closing the switchable coupling 12 come into engagement with each other. This makes it possible that opening the switchable coupling 12 is even possible while the engagement areas 14, 16 are in coupling engagement.

As a result in case the switchable coupling 12 is closed and the pawl actuation arrangement 8 is being actuated (FIG. 2*b*), bringing the crash mechanism 9 into the crash condition causes to open the switchable coupling which leads to a situation shown in FIG. 4*b*).

The coupling lever 13 is pretensioned into its closed state which corresponds to the closed state of the switchable coupling 12. In the drawings the coupling lever 13 is accordingly pretensioned in clockwise direction.

The crash element 9*a* is pivotable around a crash element axis 17 and comprises an arm 18 in order to come into engagement with the switchable coupling 12, here and preferably with the coupling lever 13, when the crash mechanism 9 is being brought into the crash condition as shown in FIG. 4. The crash element 9*a*, may, however, be movable in another way, for example in a linear manner.

In order to provide a good adaptability of the crash mechanism 9 to the respective motor vehicle door it is preferably so that the crash engagement element 9*b* is at least partly located at the outside of the motor vehicle lock 1.

As shown in the drawings the crash engagement element 9*b* comprises a bow like section 19 which at least at two end portions 20, 21 is being supported by a support arrangement 22. On one end portion 20 the support arrangement 22*a* is part of a housing component 23, which is shown in FIG. 1 in dotted lines. At the other end portion 21 the support arrangement 22*b* is provided by the crash element 9*a*. For this the crash element 9*a* comprises a reception 24 for the crash engagement element 9*b*.

The crash engagement element 9*b* is realised in a very simple way according to the drawings. In further detail the crash engagement element 9*b* is provided by a bendable wire or strip. The wire or strip is preferably made of metal, further preferably of spring steel as noted above. The crash engagement element 9*b* may be formed in a way that the bendability is guaranteed as needed.

The bendable wire or strip may be at least partly elastically bendable. Generally it is possible, however, that the bendability is completely non elastic.

A motor vehicle lock 1 with a crash mechanism 9 comprising a crash engagement element 9*b* provided by a bendable wire or strip is subject of a second teaching. A lock mechanism 6 as well as a crash mechanism 9 based on the above noted free run concept is not necessary for this teaching Other than that all explanations, advantages and alternatives given above are fully applicable to the second teaching.

According to a third teaching a motor vehicle door arrangement 2 with a motor vehicle door 2*a* and assigned to the motor vehicle door 2*a* and a motor vehicle lock 1 according to the above noted teachings is claimed. Again, all explanations, advantages and alternatives given for the above noted teachings are fully applicable to this third teaching.

According to a particularly preferred embodiment, that may be applicable to all of the above, the motor vehicle door arrangement 2 comprises a motor vehicle door 2*a* with a door body shell 11, wherein the crash engagement element 9*b* of the crash mechanism 9 is arranged adjacent the door body shell 11. Further preferably the distance between the door body shell 11 and the crash engagement element 9*b* is less than 20 mm, further preferably less than 10 mm. With this arrangement of the crash engagement element 9*b* a short-term reaction of the crash mechanism 9 to crash induced deformations can be guaranteed.

The invention claimed is:

1. A motor vehicle lock for a motor vehicle door arrangement, the motor vehicle lock comprising: a catch and a pawl, which is assigned to the catch, wherein the catch can be brought into an open position and into a closed position, wherein the catch, which is in the closed position, is or may be brought into holding engagement with a lock striker, wherein the pawl may be brought into an engagement position, in which the pawl is in blocking engagement with the catch and wherein the pawl may be deflected into a release position, in which the pawl releases the catch, wherein a lock mechanism is provided, which may be brought into different functional states comprising an "unlocked" state and a "locked" state via a lock actuation arrangement and wherein a pawl actuation arrangement is provided, by which actuation the pawl may be deflected into the release position depending on the functional state of the lock mechanism, wherein a crash mechanism with a crash element is provided, which crash mechanism may be brought from a normal condition into a crash condition by engagement with a component of the motor vehicle door arrangement, which component is being deformed due to a crash, wherein a switchable coupling is provided between the pawl actuation arrangement and the pawl and that the crash element is acting on the switchable coupling or is part of the switchable coupling in such a way that bringing the crash mechanism into the crash condition opens the switchable coupling and therewith lets an actuation of the pawl actuation arrangement run free, wherein the crash mechanism comprises a crash engagement element for engagement of the component of the motor vehicle door arrangement, which component is being deformed by a crash, and wherein the crash engagement element is coupled to the crash element in order to transfer at least part of the crash induced deformation movement to the crash element, wherein the crash engagement element comprises a bow section which at least on two end portions is being supported by a support arrangement, wherein on one end portion the support arrangement is part of a housing component, and wherein at least part of the crash engagement element is provided by a wire or strip which is bent on engagement with the component when the component is being deformed due to the crash.

2. The motor vehicle lock according to claim 1, wherein the lock mechanism acts on the switchable coupling for realizing the functional states "unlocked" and "locked" such that in the functional state "unlocked" the switchable-coupling closes and in the functional state "locked" opens.

3. The motor vehicle lock according to claim 1, wherein the switchable coupling comprises a coupling lever which is part of a drive train between the pawl actuation arrangement and the pawl, wherein the coupling lever may be brought into a closed state in which the coupling lever closes the drive train and into an open state in which the coupling lever opens the drive train.

4. The motor vehicle lock according claim 3, wherein the pawl actuation arrangement comprises a pawl actuation lever which is pivotable around a pawl actuation lever axis and wherein the coupling lever is linked to the pawl actuation lever eccentrically with respect to the pawl actuation lever axis.

5. The motor vehicle lock according claim 3, wherein the coupling lever comprises an engagement area and wherein a subsequent drive train component, which is or may be coupled to the pawl, comprises a counter engagement area and wherein, while the switchable coupling is in the closed state, by actuation of the pawl actuation arrangement, the engagement area comes into engagement with the counter engagement area for deflecting the pawl into the release position.

6. The motor vehicle lock according to claim 1, wherein in case the switchable coupling is closed and the pawl actuation arrangement is being actuated, bringing the crash mechanism into the crash condition causes to open the switchable coupling.

7. The motor vehicle lock according to claim 1, wherein the crash element is pivotable around a crash element axis and comprises an arm to come into engagement with the switchable coupling when the crash mechanism is being brought into the crash condition.

8. The motor vehicle lock according claim 1, wherein the crash engagement element is at least partly located at an outside of the motor vehicle lock.

* * * * *